US005320405A

United States Patent [19]

Foster et al.

[11] Patent Number: 5,320,405

[45] Date of Patent: Jun. 14, 1994

[54] PORTABLE SUNSHADE USING SLEEVE MEANS FOR REMOVABLE ATTACHMENT TO THE BACK OF A LOUNGE CHAIR

[75] Inventors: Marianne Foster; Roger Beck; Lisa Beck, all of Cupertino, Calif.

[73] Assignee: Bacchi of California, Inc., Cupertino, Calif.

[21] Appl. No.: 933,743

[22] Filed: Aug. 24, 1992

[51] Int. Cl.[5] ..... A47C 7/66

[52] U.S. Cl. ..... 297/184.17; 5/416; 5/418; 135/90; 135/102; 135/904; 297/191

[58] Field of Search ..... 297/184, 191, 219, 184.1–184.17, 297/219.1–219.12; 135/90, 102, 904; 5/414, 416, 418

[56] References Cited

U.S. PATENT DOCUMENTS

| | | | |
|---|---|---|---|
| 69,698 | 10/1867 | Power | 5/416 X |
| 129,476 | 7/1872 | Hirley | 5/414 |
| 377,886 | 2/1888 | Davis | 135/90 X |
| 692,501 | 2/1902 | Bentley | 5/416 |
| 3,584,322 | 6/1971 | McDougall | 135/102 X |
| 3,738,703 | 6/1973 | Kunimatu | 297/184 |
| 4,082,102 | 4/1978 | Heuer | 5/418 X |
| 4,093,305 | 6/1978 | Staroste | 297/184 |
| 4,506,689 | 3/1985 | Fiddler | 135/109 |
| 4,639,958 | 2/1987 | Lerner | 5/418 |
| 4,810,030 | 3/1989 | Lewis | 297/184 |
| 4,915,120 | 4/1990 | Ziolkowski | 135/90 |
| 4,978,166 | 12/1990 | James | 297/184 |
| 5,013,085 | 5/1991 | Craig | 297/184 |
| 5,092,653 | 3/1992 | Felling | 297/184 |
| 5,135,281 | 8/1992 | Pappalardo | 297/184 |
| 5,154,473 | 10/1992 | Joranco | 297/184 |
| 5,203,363 | 4/1993 | Kidwell et al. | 297/184 |

FOREIGN PATENT DOCUMENTS

| | | | |
|---|---|---|---|
| 363004 | 11/1922 | Fed. Rep. of Germany | 135/102 |
| 492357 | 2/1930 | Fed. Rep. of Germany | 5/414 |
| WO82/01985 | 6/1982 | PCT Int'l Appl. | 297/184 |

*Primary Examiner*—Lloyd A. Gall
*Attorney, Agent, or Firm*—John S. Ferrell

[57] ABSTRACT

A sunshade comprising a plurality of U-shaped bails, pivotally joined together at each end by a plastic joint. A fabric web ensheathes the bails and creates a shade-providing canopy when the bails are spread apart from each other in fan-like fashion. A framing bail frames a fabric sleeve and provides means for supporting the sunshade in an upright position. The sleeve non-mechanically engages the sunshade to the back portion of a chair. A cover, that extends beyond the sleeve, is used when the portable sunshade is in a folded disposition. The ends of the cover are fastened together to keep the sunshade clamped shut. A strap is provided for ease of carrying the portable sunshade.

8 Claims, 3 Drawing Sheets

PORTABLE SUNSHADE USING SLEEVE MEANS FOR REMOVABLE ATTACHMENT TO THE BACK OF A LOUNGE CHAIR

BACKGROUND OF THE INVENTION

1. Field of the Invention

This invention relates generally to a portable sunshade, and more particularly to a foldable and retractable sunshade that can be used either freestanding or slip-mounted onto the back of a lounge chair.

2. Description of the Background Art

Most sunshades are designed to be permanently mounted or removably fastened to a chaise lounge, folding chair or infant car seat. While the permanently mounted sunshades are not portable at all, the portability of the removable sunshades is subject to the tedious task of mechanically fastening and unfastening the shade from the lounge by use of clamps or screws. Thus, with most portable sunshades some assembly is required.

Most sunshades are designed for use in conjunction with a chair or seat, and cannot be used freestanding. Because such shades must be mechanically attached to the side or seat member of a chair using clamps, screws, or clips, these shades have no base of their own upon which to balance or stand when not attached to an item of furniture. Shade users desiring to incline in a generally horizontal position while still using the shade, must do so on a reclinable lounge chair. They cannot use such shades in conjunction with, say a towel laid upon the sand at a beach, because there is no structural support upon which to attach the shade for stability and balance.

What is needed is a portable sunshade that simply engages a lounge or chair, requiring no mechanical attachment thereto, and is capable of standing on its own so as to be used in conjunction with a towel or blanket placed upon the ground.

SUMMARY OF THE INVENTION

The present invention is a sunshade having a plurality of U-shaped bails, where the ends of the bails are pivotally connected to each other at a plastic joint. Each bail is ensheathed by a fabric web. The bails can pivot about the joint and spread apart from each other in fan-like fashion until restricted from further travel by the limitations of the web. When the bails are spread apart, the web creates a shade-providing canopy. A framing bail, not ensheathed by the web, provides a structural frame for a fabric sleeve. This sleeve is slipped over the back of a lounge chair, providing a convenient attachment means thereto. The outer ply of the sleeve extends beyond the ends of the bail to form a cover for the sunshade. With all of the bails gathered together, the cover can be folded in half and fastened together by a flap, thereby clamping the bails together in a closed fashion. The sleeve further functions as a convenient storage compartment for carrying small items when the sunshade is folded and being carried. A shoulder strap is connected to joints at opposite ends of the sunshade for ease of carrying.

DETAILED DESCRIPTION OF THE PREFERRED EMBODIMENT

Figure 1:
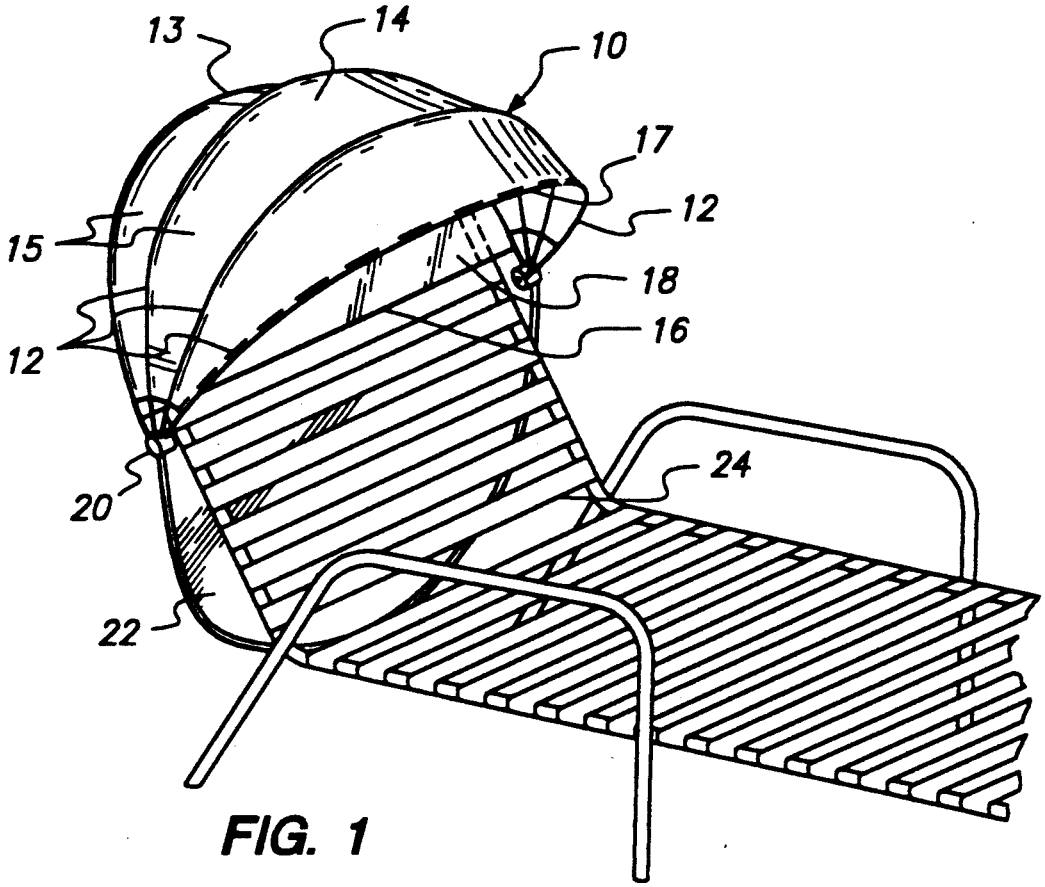
FIG. 1 is a perspective view of the sunshade in accordance with the present invention shown in an operative position over the back of a lounge chair.

Referring now to FIG. 1, a sunshade 10 in accordance with the present invention includes a plurality of bails 12. Although a quantity of four are illustrated, as few as two or as many as desired can be used as well. Each U-shaped bail 12 is disposed parallel to every other bail 12 used. The ends of each bail 12 are joined to the corresponding ends of every other bail 12.

Each bail 12 is ensheathed by a web 14. The web 14 is a generally oval shaped portion of weather resistant fabric that is comprised of individual elongated oval sections of webbing 15. Each individual section of webbing 15 includes a casing 17 along each of its long edges, where the casing 17 is made from either a fold along the edge of the section 15 or from the joinder of the section of webbing 15 with an adjacent section of webbing 15. Thus, the outermost bails 12 are ensheathed within a casing 17 made from the folded edge of a section of webbing 15, while the intermediate bails 12 are ensheathed by a casing 17 that is formed from the joinder of two adjacent sections of webbing 15.

As the bails 12 are pivoted away from each other, to place more distance between each bail 12, the web 14 is spread open to form a canopy. The movement of the bails 12 is limited by the width of the sections of webbing 15 between adjacent bails 12. With the bails 12 in the fully fanned-out position, the canopy forming web 14 provides the most shade thereunder.

A framing bail 13 is encased in a semi-circular sleeve 18 an opening 16. The opening 16 is formed between the semi-circular sleeve 18 and a cover 22. The framing bail 13 forms a framework for supporting the semi-circular sleeve 18 and can be rotated to a position 90 degrees from the rest of the bails 12 to function as a stand for the sunshade 10 when it is used on the ground, as described in more detail with FIGS. 5 and 6 below. A pair of cylindrically shaped joints 20 connect the ends of the bails together in series. The joint 20 will be described in detail with FIG. 2.

A fabric cover 22 extends beyond the semi-circular sleeve 18. Cover 22 encloses and protects the sunshade 10 from dirt and damage when it is not in use, or when it is being carried. When the sunshade 10 is in use, the cover 22 can be folded or tucked away unobtrusively.

When sunshade 10 is used in conjunction with lounge chair 24, as is shown in FIG. 1, sunshade 10 is engaged to lounge chair 24 by manually spreading apart sleeve opening 16 and slipping sleeve 18 over the back of lounge chair 24, with framing bail 13 behind the back of chair 24. Gravity, the weight of the sunshade 10, and the taut sleeve opening 16, keep the sunshade 10 in place atop the lounge chair 24, thus eliminating the need for mechanical fasteners or clamps. The cover 22 hangs down unobtrusively behind the lounge chair 24.

Figure 2:
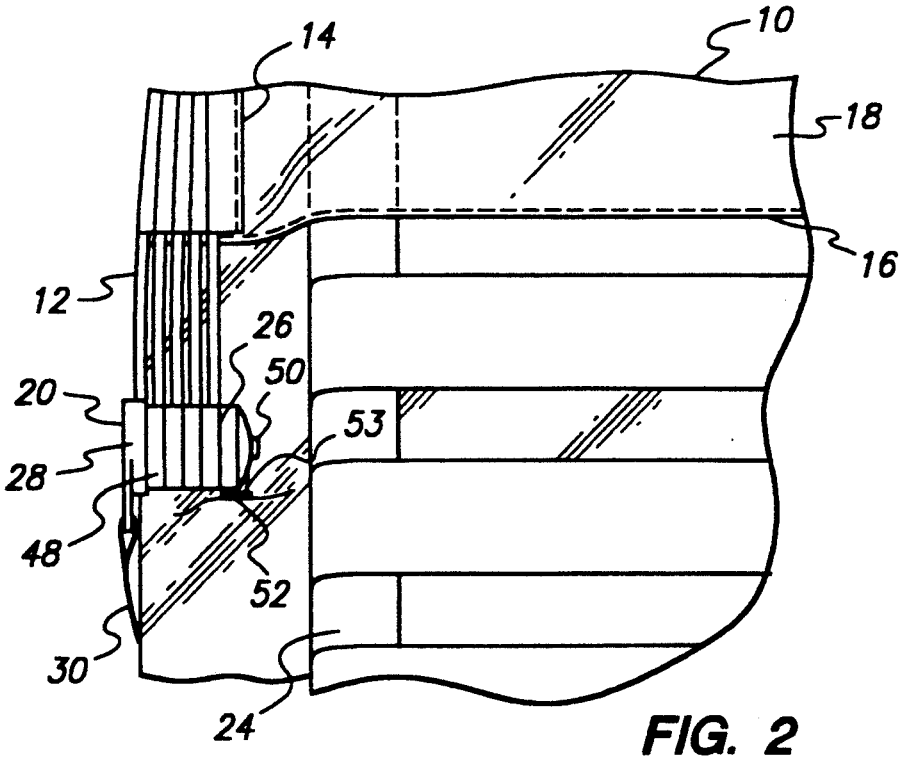
FIG. 2 is a partial front view of the sunshade and lounge chair of FIG. 1, illustrating one of the joints on the sunshade.

In FIG. 2, a front view of a portion of the lounge chair 24 and sunshade 10 of FIG. 1 is shown, illustrating the details of joint 20. The bails 12 extend beyond the coverage of the web 14. Affixed to the ends of each bail 12 is a circular plastic ring 48.

The joint 20 is comprised of a cap 26 and a base 28, with plastic rings 48 being sandwiched therebetween. The cap 26, rings 48 and base 28 are connected by a shaft 50 disposed centrally therethrough. A fixing means 52, 53 is provided for affixing cover 22 to joint 20. In the preferred embodiment, shaft 50 comprises a metal bolt which may be manually tightened to lock joint 20 and thereby prevent bails 12 from moving. This is useful for locking an installed sunshade 10 into an open position on a lounge chair. This preferred shaft 50 may also be tightened moderately to prevent undesired movement of the bails 12 as a result of wind. Shoulder strap 30 is shown attached to joint 28.

Figure 3:
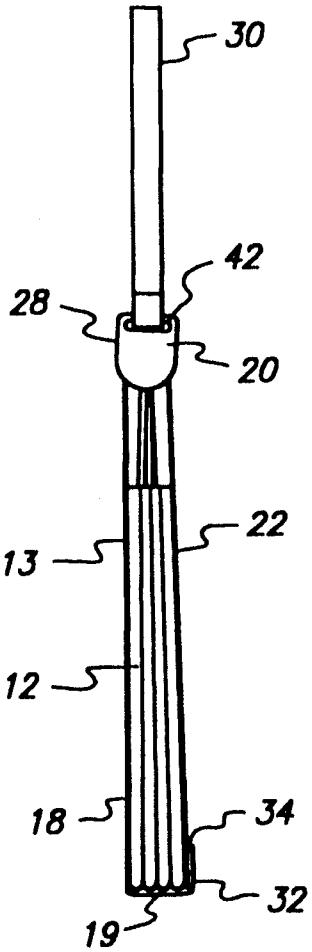
FIG. 3 is a side view of the sunshade of FIG. 1 in a folded disposition, showing the cover closed by the flap and also illustrating the carrying position of the sunshade.

FIG. 3 is a side view of a sunshade in a folded disposition. To fold sunshade 10 of the present invention, bails 12 are pivoted until they are immediately adjacent to each other. Likewise, the framing bail 13, forming the structure for the sleeve 18 is brought together with the other bails 12. The cover 22 is folded about joint 20 and brought towards the bails 12 until the edges of the cover rest atop bails 12. A rectangular flap 32 is stitched at one end to the side forming the outer portion of sleeve 18, and is brought over apexes 19 of gathered bails 12 and is then removably attached to connector 34 which is mounted on cover 22. Examples of removably attachable connectors include VELCRO TM snaps or buttons.

Also shown is a slot 42 in the base 28 of joint 20 for engaging a carrying strap 30. With sunshade 10 in the folded position, strap 30 can be placed over one's shoulder to facilitate carrying the portable sunshade 10. When sunshade 10 is disposed in its carrying position, sleeve 18 forms a pocket inside the cover 22 of sunshade 10 that can be used to hold personal items such as tanning lotion, magazines, towels, etc.

Figure 4:
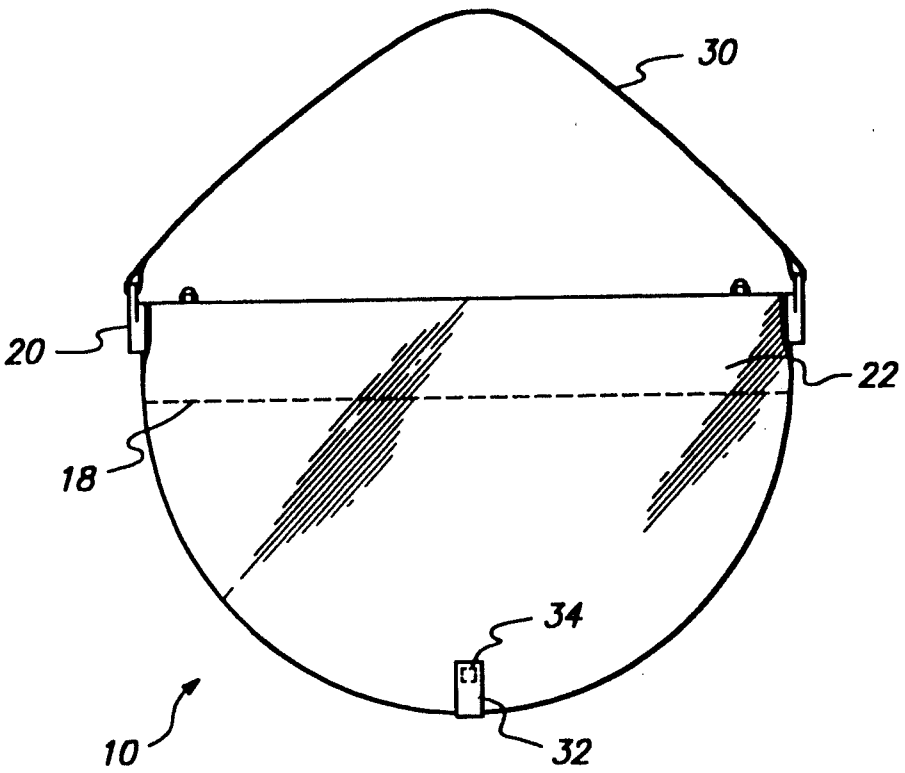
FIG. 4 is a front view of the folded sunshade of FIG. 3, showing selected hidden lines.

FIG. 4 is a front view of a folded sunshade 10 in accordance with the present invention again showing flap 32 mated to a hidden connector 34, shown in dashed lines, that functions to maintain sunshade 10 in a closed disposition. Sleeve 18, hidden in this view, is also shown by dashed lines. When sunshade 10 is folded in the manner shown in this figure, sleeve 18 provides utility as a storage pocket for carrying small items such as sun glasses, towels, sun screen and the like. The strap 30 and sunshade 10 is again illustrated in the carrying position.

Figure 5:
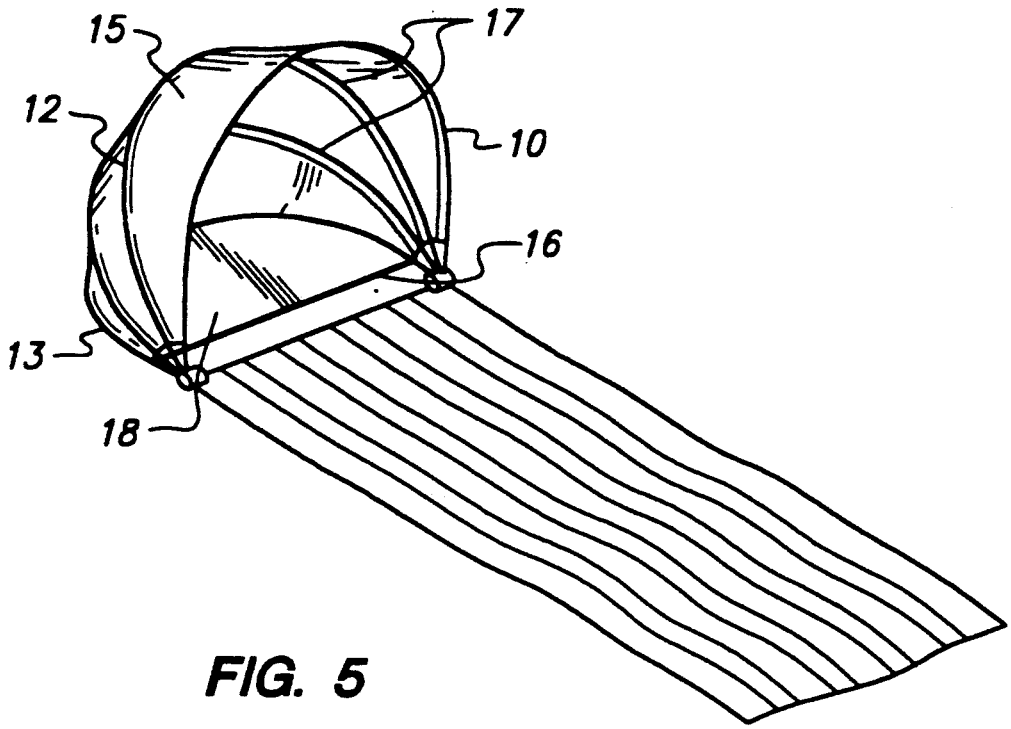
FIG. 5 is perspective view of the sunshade of FIG. 1 showing the sunshade in a ground application wherein the user lays on a towel on the ground and can adjust the sunshade to block sun from the eyes and head.
Figure 6:
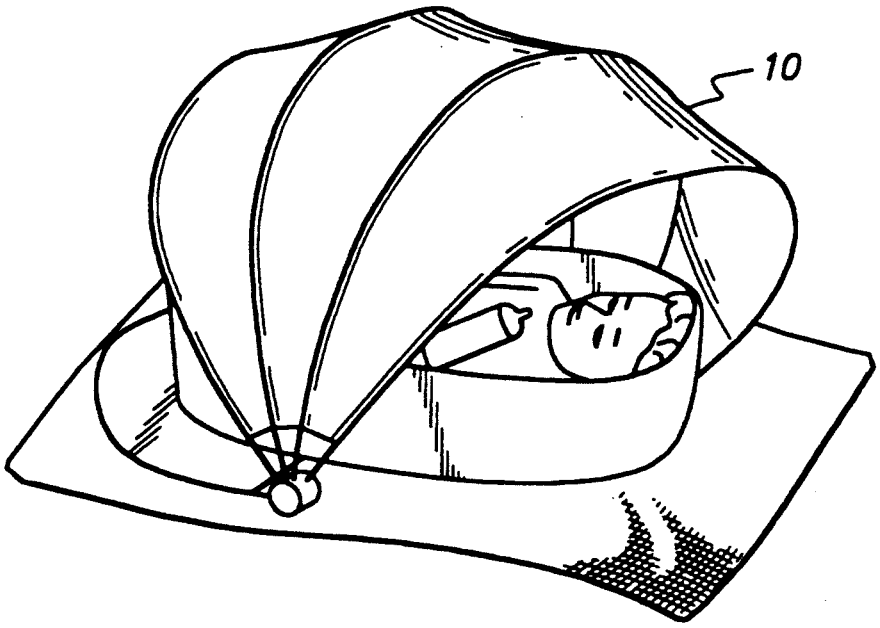
FIG. 6 is perspective view of the sunshade of FIG. 1 showing the sunshade in a ground application wherein the canopy of the sunshade can be adjusted to protect an infant from sun.

FIG. 5 demonstrates the use of sunshade 10 on the ground, in a freestanding operating mode. When sunshade 10 is used in this mode, framing bail 13 and sleeve 18 are laid flat on the ground and the user may utilize sleeve 18 as a headrest, while keeping the user's head off the ground. Additionally, a blanket, towel or other soft materials may be inserted into sleeve opening 16 forming a pillow to cushion and support the user's head. In an alternative use, cover 22 can be spread out on the ground adjacent to sleeve 18 thereby serving as a ground cloth separating the user's upper body from contact with the ground. During ground use, the canopy formed by bails 12 and webbing sections 15 may be freely rotated to block the sun from the user's face or upper body, as in the infant protection use illustrated in FIG. 6.

In summary, a sunshade 10 is disclosed having a plurality of bails 12 separated by sections of webbing 15 for providing shade from the sun. The bails are joined at each of two ends by a joint 20 which is further comprised of rings 48 for rotating and thereby permitting separation of bails 12. The sunshade 10 is installed on the back of a lounge chair 24 by spreading a sleeve opening 16 and sliding the sleeve 18 over the back of the chair 24. The sunshade 10 further comprises a cover 22 and a strap 30 enabling convenient portability.

Although the present invention has been described above in terms of a specific embodiment, it is anticipated that alterations and modifications thereof will no doubt become apparent to those skilled in the art. It is therefore intended that the following claims be interpreted as covering all such alterations and modifications as fall within the true spirit and scope of the invention.

What is claimed is:

1. A portable sunshade for use on a lounge chair comprising:

canopy means for blocking sun rays, where said canopy means is expandable and retractable to provide varying degrees of shade;

pivot means attached to said canopy means for allowing said canopy means to be expandable and retractable; and brace means connected to said pivot means for providing support to said canopy means, and for attaching said canopy means to a lounge chair, wherein said brace means further comprises a semicircular bail that forms a frame for and is contained within a sleeve, and wherein said sleeve receivingly engages a back portion of said lounge chair such that said sunshade is securely attached to said lounge chair.

2. The portable sunshade as recited in claim 1 wherein said canopy means includes at least two semicircular bails, where said at least two bails each has a first end and a second end, said first end of said bails being joined and said second end of said bails being joined, further including a web disposed therebetween.

3. The portable sunshade as recited in claim 2 wherein said web is an elongated oval shaped piece of fabric having casings formed along each edge thereof.

4. The portable sunshade as recited in claim 3 wherein said web fabric is resistant to water and weather.

5. The portable sunshade as recited in claim 2 wherein said first end and said second end of said bails further include plastic rings affixed thereto.

6. The portable sunshade as recited in claim 5 wherein said pivot means includes a joint comprised of said plastic rings disposed in series and pivotally fastened about a lockable shaft disposed centrally therethrough.

7. The portable sunshade as recited in claim 6 wherein said joint further includes a cap disposed at one end of said series of rings and a base disposed at the opposite end of said series of rings, where said cap and base are also fastened to said shaft.

8. The portable sunshade as recited in claim 1 further comprising a strap connected to said pivot means, for carrying said sunshade.

* * * * *